US011472693B2

(12) United States Patent
Bendig

(10) Patent No.: US 11,472,693 B2
(45) Date of Patent: Oct. 18, 2022

(54) BEVERAGE DISPENSER VALVE WITH FILL DETECTION

(71) Applicant: Marmon Foodservice Technologies, Inc., Osseo, MN (US)

(72) Inventor: James Bendig, Naperville, IL (US)

(73) Assignee: Marmon Foodservice Technologies, Inc., Osseo, MN (US)

( * ) Notice: Subject to any disclaimer, the term of this patent is extended or adjusted under 35 U.S.C. 154(b) by 0 days.

(21) Appl. No.: 17/336,893

(22) Filed: Jun. 2, 2021

(65) Prior Publication Data

US 2021/0380394 A1 Dec. 9, 2021

Related U.S. Application Data

(60) Provisional application No. 63/034,135, filed on Jun. 3, 2020.

(51) Int. Cl.

| | |
|---|---|
| ***B67D 1/12*** | (2006.01) |
| ***B67D 1/08*** | (2006.01) |
| ***B67D 1/00*** | (2006.01) |

(52) U.S. Cl.

CPC ..... *B67D 1/1238* (2013.01); *B67D 1/0085* (2013.01); *B67D 1/0888* (2013.01); *B67D 2001/009* (2013.01); *B67D 2001/1263* (2013.01)

(58) Field of Classification Search

CPC .... B67D 1/1238; B67D 1/124; B67D 1/1243; B67D 1/1236; B67D 1/1247; B67D 1/0085; B67D 2001/009; B67D 2001/1259; B67D 2001/1263

See application file for complete search history.

(56) References Cited

U.S. PATENT DOCUMENTS

| | | | | |
|---|---|---|---|---|
| 5,036,892 | A * | 8/1991 | Stembridge | B67D 3/0003 367/908 |
| 5,868,311 | A | 2/1999 | Cretu-Petra | |
| 6,053,359 | A | 4/2000 | Goulet et al. | |
| 6,354,468 | B1 | 3/2002 | Riek | |
| 6,394,153 | B2 * | 5/2002 | Skell | B67D 1/1238 141/351 |
| 6,688,134 | B2 | 2/2004 | Barton et al. | |
| 6,789,585 | B1 | 9/2004 | Janke | |

(Continued)

FOREIGN PATENT DOCUMENTS

| | | | |
|---|---|---|---|
| CN | 105264312 | B | 6/2018 |
| EP | 1647951 | A1 | 4/2006 |

(Continued)

OTHER PUBLICATIONS

International Search Report and Written Opinion for PCT/US2021/035654, dated Sep. 1, 2021.

*Primary Examiner* — Timothy L Maust

(74) *Attorney, Agent, or Firm* — Andrus Intellectual Property Law, LLP

(57) ABSTRACT

A system and method for dispensing a beverage includes the detection of a presence of a cup underneath a nozzle, and in response to the detected presence of the cup, a target fill height is calculated. The controller operates to begin a dispense of a beverage into the cup. A beverage fill height determined and compared to a target fill height. When the beverage fill height exceeds the target fill height, the controller operates to stop dispensing the beverage into the cup.

11 Claims, 10 Drawing Sheets

(56) References Cited

U.S. PATENT DOCUMENTS

| | | | | |
|---|---|---|---|---|
| 7,614,524 | B2 | 11/2009 | Girard et al. | |
| 7,673,661 | B2 | 3/2010 | Chase et al. | |
| 8,490,540 | B2 | 7/2013 | Webster et al. | |
| 8,505,593 | B1 * | 8/2013 | Denise | B67D 1/1236 141/351 |
| 8,695,646 | B2 * | 4/2014 | Agam | G01S 15/87 141/94 |
| 8,950,254 | B2 | 2/2015 | Bernhardsgruetter et al. | |
| 9,417,003 | B2 | 8/2016 | Baack | |
| 9,477,317 | B1 | 10/2016 | Clements | |
| 9,840,407 | B2 | 12/2017 | Difatta et al. | |
| 10,053,354 | B2 | 8/2018 | Rosenlund et al. | |
| 10,178,928 | B2 | 1/2019 | Ophardt et al. | |
| 10,235,865 | B2 | 3/2019 | Thyroff | |
| 10,258,191 | B2 | 4/2019 | Apone et al. | |
| 10,269,082 | B2 | 4/2019 | Morris et al. | |
| 10,362,896 | B2 | 7/2019 | Apone et al. | |
| 10,571,041 | B2 | 2/2020 | Bischel | |
| 11,117,793 | B1 * | 9/2021 | Khan | B67D 1/0888 |
| 2003/0155031 | A1 | 8/2003 | Barton et al. | |
| 2008/0282897 | A1 | 11/2008 | Webster et al. | |
| 2009/0178728 | A1 | 7/2009 | Cochran et al. | |
| 2009/0308494 | A1 | 12/2009 | Linn | |
| 2013/0075426 | A1 | 3/2013 | Crane et al. | |
| 2014/0224375 | A1 * | 8/2014 | Willis | B67D 1/0858 141/94 |
| 2016/0207753 | A1 | 7/2016 | Choi et al. | |
| 2017/0079468 | A1 | 3/2017 | Apone et al. | |
| 2017/0079469 | A1 | 3/2017 | Apone et al. | |
| 2018/0201492 | A1 | 7/2018 | Jung et al. | |
| 2018/0327243 | A1 | 11/2018 | Rider et al. | |
| 2019/0223654 | A1 | 7/2019 | Apone et al. | |
| 2020/0000274 | A1 | 1/2020 | Apone et al. | |
| 2020/0055720 | A1 | 2/2020 | Volftsun et al. | |

FOREIGN PATENT DOCUMENTS

| | | | |
|---|---|---|---|
| EP | 2449929 | A1 | 5/2012 |
| EP | 3172970 | A1 | 5/2017 |
| EP | 3275348 | A1 | 1/2018 |
| EP | 3670436 | A1 | 6/2020 |

* cited by examiner

BEVERAGE DISPENSER VALVE WITH FILL DETECTION

CROSS-REFERENCE TO RELATED APPLICATIONS

The present application claims priority to U.S. Provisional Patent Application No. 63/034,135 filed on Jun. 3, 2020, and which is incorporated by reference herein in its entirety.

FIELD

The present disclosure relates to a touchless beverage valve assembly for ice and beverage dispensing machines.

BACKGROUND

The following U.S. Patents provide background information and are incorporated by reference in their entireties.

U.S. Pat. No. 10,077,180 discloses a beverage dispensing head includes a housing having a front, a rear, and a base that extends between the front and the rear. A mixing nozzle is configured to dispense a flow of beverage via the base. A valve is configured to control the flow of beverage via the mixing nozzle, and a switch is movable into and between a closed position in which the valve opens the flow of beverage via the mixing nozzle and an open position in which the valve closes the flow of beverage via the mixing nozzle. A lighting module disposed in the housing is configured to illuminate the front of the housing and the base of the housing when the switch is moved into the closed position.

U.S. Pat. No. 9,840,407 discloses a beverage dispensing system that includes a plurality of beverage sources each containing a beverage component, and at least one flow valve connected to one or more of the beverage sources and operable to control a flow of the beverage component therefrom. The system further includes a graphical display that presents a plurality of available beverages and a gesture capture device that receives a selection gesture input to select a beverage from the plurality of available beverages. A controller is also included that adjusts the at least one flow valve based on the selection gesture input to dispense the selected beverage.

U.S. Pat. No. 6,053,359 discloses an automated system for preparing and delivering postmix beverages in response to one or more drink orders being entered from a remote point of sale unit or a local keypad that includes: a postmix beverage preparation assembly for dispensing ice and a selected postmix beverage into a cup; an oblong carousel type conveyor assembly including a plurality of upwardly open cup holders which are driven by a motor driven belt so as to pass beneath a cup dispensing station, an ice dispensing station, a beverage dispensing station, and a plurality of pick-up stations; a cup storage and dispenser assembly including a bidirectionally rotatable turret upon which is mounted a plurality of different sized cup supply tubes for holding a respective stack of beverage cups; and a pneumatic vertically driven cup gripper/extractor mechanism having a pair of pneumatically operated gripper arms which operate to remove a cup from a selected supply tube on the turret and placing the extracted cup into an empty cup holder which is then transported past the dispensing stations and then to a pick-up station on the conveyor for manual removal by an attendant.

U.S. Patent Application Publication No. 2013/0075426 discloses a beverage dispensing apparatus that includes a dispensing structure, a transportation mechanism linked with the dispensing structure, and a staging structure linked with the transportation structure. A control system is linked with the dispensing structure, the staging structure, and the transportation mechanism. A sensor mechanism is linked with the control system. The sensor mechanism provides signals indicating the position of a cup. A cup identification system having an interactive display is connected to the control system. The display has visual characteristics indicating the position and characteristics of a cup.

U.S. Application Publication No. 2015/0219380 and U.S. Application Publication No. 2021/0033329 disclose ice dispensers and features thereof.

BRIEF DISCLOSURE

This section is provided to introduce a selection of concepts that are further described herein below in the Detailed Description. It is not intended to identify key or essential features of the claimed subject matter, nor is it intended to be used as an aid in limiting the scope of the claimed subject matter.

An example of a touchless beverage valve assembly includes a nozzle, an optical sensor, and a radar sensor. A valve is coupled upstream of the nozzle. The valve configured to control a flow of a substance through the valve to the nozzle. A solenoid is operatively connected to the valve and configured to operate the valve between an open condition and a closed condition. A controller is configured to receive output signals from the optical sensor and the radar sensor. The controller operates the solenoid to control the valve between an open condition to dispense the substance through the nozzle and a closed condition.

In other examples, the controller is configured to detect a presence of a cup below the nozzle based upon the output signals from the optical sensor. The controller is configured to determine a cup height (H) of the cup below the nozzle from the output signals from the optical sensor. The controller is configured to calculate a target fill height based upon the cup height and a safety margin (M). The controller is configured, once the valve is in the open condition, to determine a current fill height of beverage within the cup based upon the output signals from the radar sensor. The controller is configured to compare the current fill height to the target fill height and operate the solenoid to control the valve to the closed condition when the current fill height reaches or exceeds the target fill height. The controller is configured to calculate an estimated fill height based upon at least a beverage flow rate and a dispense time. The controller is configured to compare the current fill height to the estimated fill height. The controller is configured to operate the solenoid to control the valve to the closed condition if the current fill height exceeds the estimated fill height by a predetermined amount. When the current fill height exceeds the estimated fill height by the predetermined amount, the controller is further configured to evaluate the current fill height until the current fill height reaches an equilibrium, the controller is configured to then compare the current fill height to the target fill height and operate the solenoid to control the valve to the open condition if the current fill height is below the target fill height.

In further examples, the optical sensor is an infrared (IR) sensor. A drip tray positioned below the nozzle and configured to support a cup. The controller is configured to perform a calibration routine wherein the controller calculates an average distance measurement based upon a plurality of distance measurements using the output signals from at least the optical sensor. The controller is configured to detect a presence of a cup below the nozzle based upon the output signals from the optical sensor compared to the average distance measurement.

An example of a method of dispensing a beverage from a beverage dispensing system includes detecting a presence of a cup underneath a nozzle. In response to detecting the presence of the cup, a target fill height is calculated. A valve is operated to an open condition to dispense a beverage through the nozzle into the cup. A current fill height of the beverage in the cup is determined. The current fill height is compared to the target fill height. In response to determining that current fill height reaches or exceeds the target fill height, the valve is operated to a closed condition to stop dispense of the beverage through the nozzle into the cup.

In examples of the method an optical sensor is operated to produce optical sensor output signals representative of a distance from which light frequency waves of the optical sensor is reflected back to the optical sensor. A cup height (H) of the cup below the nozzle is determined from the output signals. The target fill height is calculated based at least upon the cup height (H) and a safety margin (M). A radar sensor is operated to produce a radar sensor output signal representative of a distance from which radio frequency waves from the radar sensor are reflected back to the radar sensor. The current fill height of beverage is continuously determined from the radar sensor output signal. The current fill height is compared to the target fill height. The valve is operated to the closed condition, when the current fill height reaches or exceeds the target fill height. An estimated fill height is based upon at least a beverage flow rate and a dispense time. The current fill height is compared to the estimated fill height. The valve is operated to the closed position when the current fill height exceeds the estimated fill height by a predetermined amount. The current fill height is evaluated until the current fill height reaches an equilibrium. The valve is operated to the open condition. The optical sensor may be an infrared (IR) sensor. The presence of the cup may be detected using an RGB-D camera.

BRIEF DESCRIPTION OF THE DRAWINGS

The present disclosure includes the following Figures. The same numbers are used throughout the Figures to reference like features and like components.

DETAILED DISCLOSURE

In the present description, certain terms have been used for brevity, clearness, and understanding. No unnecessary limitations are to be inferred therefrom beyond the requirement of the prior art because such terms are used for descriptive purposes only and are intended to be broadly construed.

The present disclosure generally relates to ice and beverage dispensing systems with improved sanitary features. Beverage dispensers are commonly used in restaurants and convenience stores to mix a beverage concentrate with carbonated or non-carbonated water, and to cool the mixed beverage. In some instances, the ice and beverage dispensing systems are operated solely by the employees of restaurants and convenience stores in order to reduce the risks associated with permitting customers to operate the dispensing systems. These risks include, but are not limited to, incorrect operation of the system and pathogen spread due to the presence of high touch surfaces on the system. Although restricting dispenser use to employees may mitigate the risks of pathogen spread from high touch surfaces, it does not fully eliminate them. The present inventors have recognized that customer comfort and safety would be increased through the use of an ice and beverage dispenser with beverage valve assemblies that do not require contact for operation.

Figure 1:
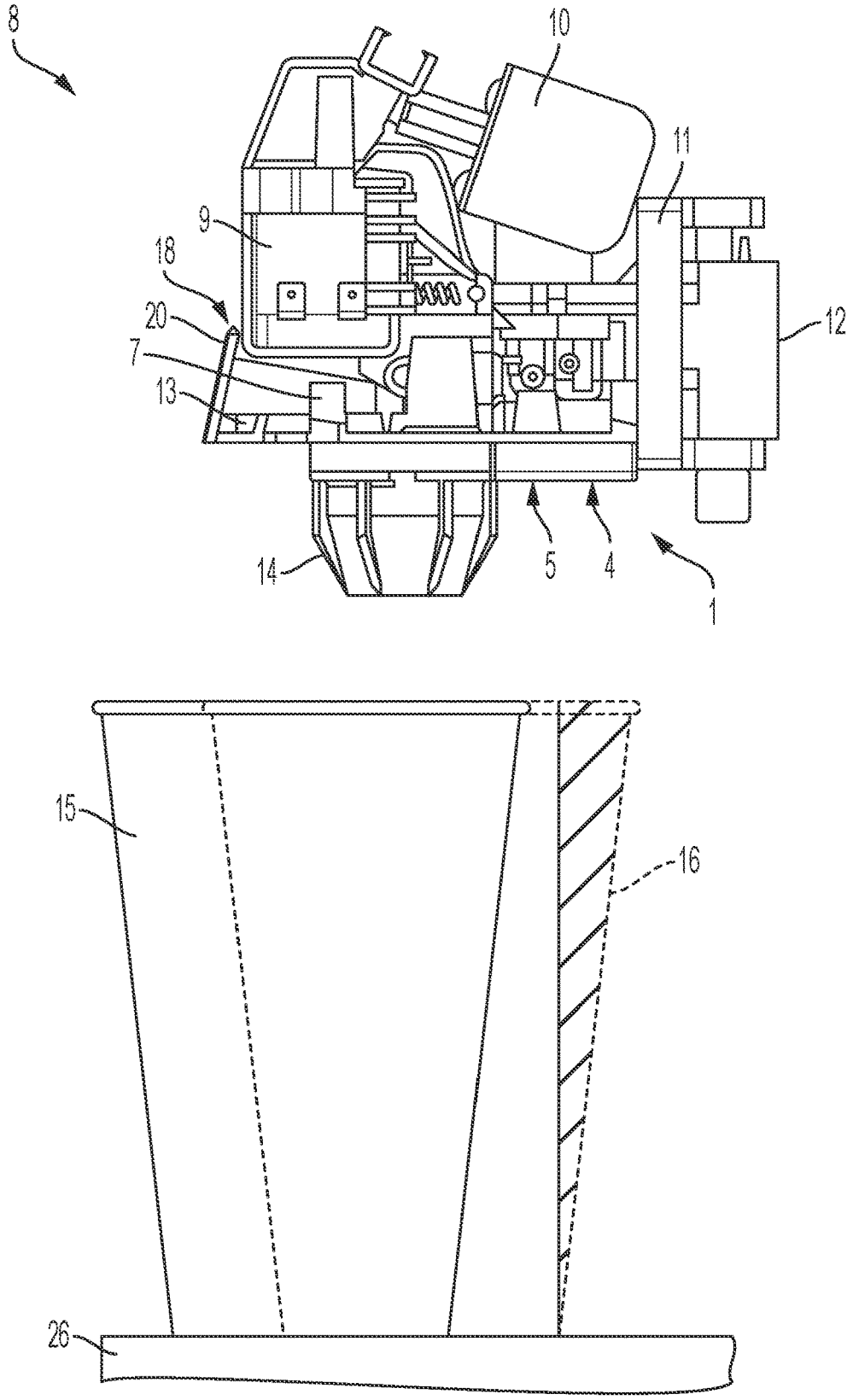
FIG. 1 is a side cross-sectional view of the touchless beverage valve assembly.
Figure 2:
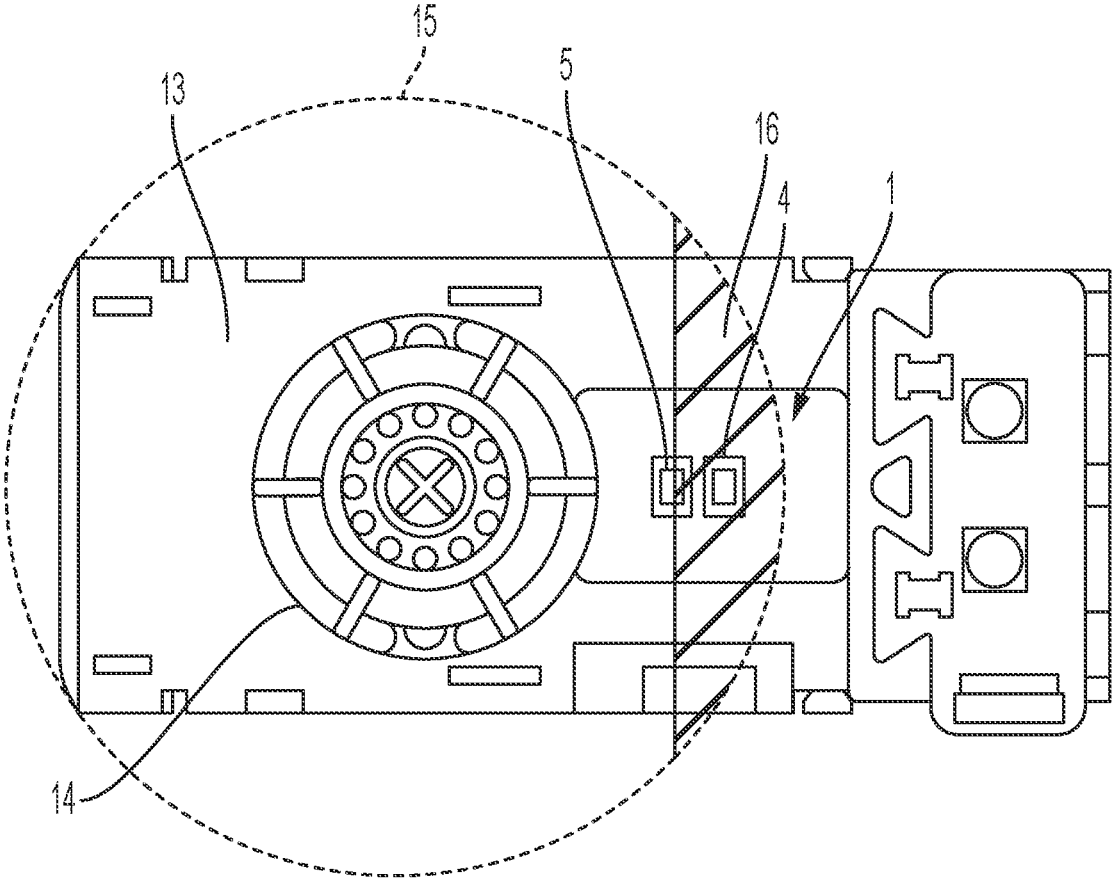
FIG. 2 is a bottom view of the touchless beverage valve assembly.

FIG. 1 depicts an example of a touchless beverage valve assembly 8, as shown and described in detail herein. Examples of the touchless beverage valve assembly 8 can provide improved sanitation in operation and use. The touchless beverage valve assembly 8 is shown to include, among other components a trigger sensor 1. The trigger sensor 1 can include various components and implementations as described herein all of which are considered to be variations of the disclosed trigger sensor. The touchless beverage valve assembly 8 further includes a nozzle 14 coupled to the underside of a valve base plate 13. A solenoid 9 is operatively connected to a valve 10. The valve 10 is connected to a valve mounting block 11 and a back block 12 to a source of the substance to be dispensed. The solenoid 9 operates to actuate the valve 10 between an open condition that permits the flow of a substance through the valve 10 and a closed condition that occludes flow of the substance through the valve 10. It will be recognized that while the present disclosure uses the example of a liquid, which may exemplarily include water, carbonated water, a pre-mixed beverage, or a post-mixed beverage, in other examples, the substance may be ice, and the arrangement and configuration of components for ice dispensing will be recognized based upon the disclosure provided herein, as well as the references noted above, the contents of which have incorporated by reference.

Above the valve base plate 13, the valve assembly 8 includes a controller 7, which is exemplarily a single board computer (SBC) or a central processing unit (CPU), that includes a processor. The processor of controller 7 may be integral with or communicatively connected to a computer-readable medium upon which computer-readable code is stored. Upon execution of the computer-readable code by the processor, the processor performs functions and calculations and subsequently transmits control signals as described herein. The controller 7, is communicably coupled to the trigger sensor 1, the valve solenoid 9, and a feedback device 20. As described herein, the controller operates to coordinate the detection of a receptacle with the trigger sensor 1 with the operation of the valve solenoid 9 to dispense a substance and control the feedback device 20 to communicate an operational status of the dispenser to a user.

In examples, the touchless beverage valve assembly 8 operates to dispense a beverage into a receptacle based upon a touchless interaction with the touchless beverage valve assembly 8. In an example detailed herein the trigger sensor 1 includes both an infrared (IR) sensor 4 and a radar sensor 5. The IR sensor is exemplarily used to detect the presence of the cup, while the radar sensor is used to detect a height of a beverage dispensed into the cup. The trigger sensor 1, including the IR sensor and/or radar sensor comprised therein communicates this detection data to the controller 7. In an example, the trigger sensor 1 detects the presence of the receptacle, which may be a cup 15, beneath the nozzle 14. In an exemplary implementation, at least one optical sensor 4 of the trigger sensor 1 is positioned such that the at least one optical sensor 4 detects a cup target zone 16 that is below the trigger sensor 1 and in the region of the rear lip of the cup 15 (depicted as the shaded regions).

The optical sensor 4 may be any of a variety of photoelectric sensors. Examples of the optical sensor 4 may include a through-beam sensor, a reflective through-beam, a reflective laser, or a diffuse photoelectric sensor. While an example of an infrared (IR) sensor is provided herein, optical sensors within the scope of the present disclosure may operate within visible or infrared (IR) light frequency bands. Signals from the at least one optical sensor may be provided to and analyzed directly by the controller, or a trigger sensor controller 3 may be provided as a component of the trigger sensor 1, the trigger sensor controller 3 may initially receive the outputs of the optical sensor 4 and/or the radar sensor 5, for example in proximity sensing or range sensing implementations. The trigger sensor controller 3 may then provide a preprocessed output on to the controller 7. In an exemplary implementation, the trigger sensor 1 is implemented in part by a VL6180 proximity sensing module manufactured by STMicroelectronics that includes both an infrared emitter and a range sensor. The infrared emitter and the range sensor act as a time-of-flight sensor by calculating range measurements based on the time it takes light emitted from the infrared emitter to travel to the nearest object and reflect back to the range sensor. In this way, distance measurements are obtained independent of the reflectance of the target object, meaning that the optical sensor 4 is operable in the presence of both clear and transparent cups, as well as cups filled with ice. In other implementations, a different style of distance sensor (e.g., laser, lidar, radar, ultrasonic) may be utilized. In some implementations, these sensing technologies may be utilized to confirm the presence of ice in a cup and/or to determine the fill height of liquid in a cup.

Figure 10:
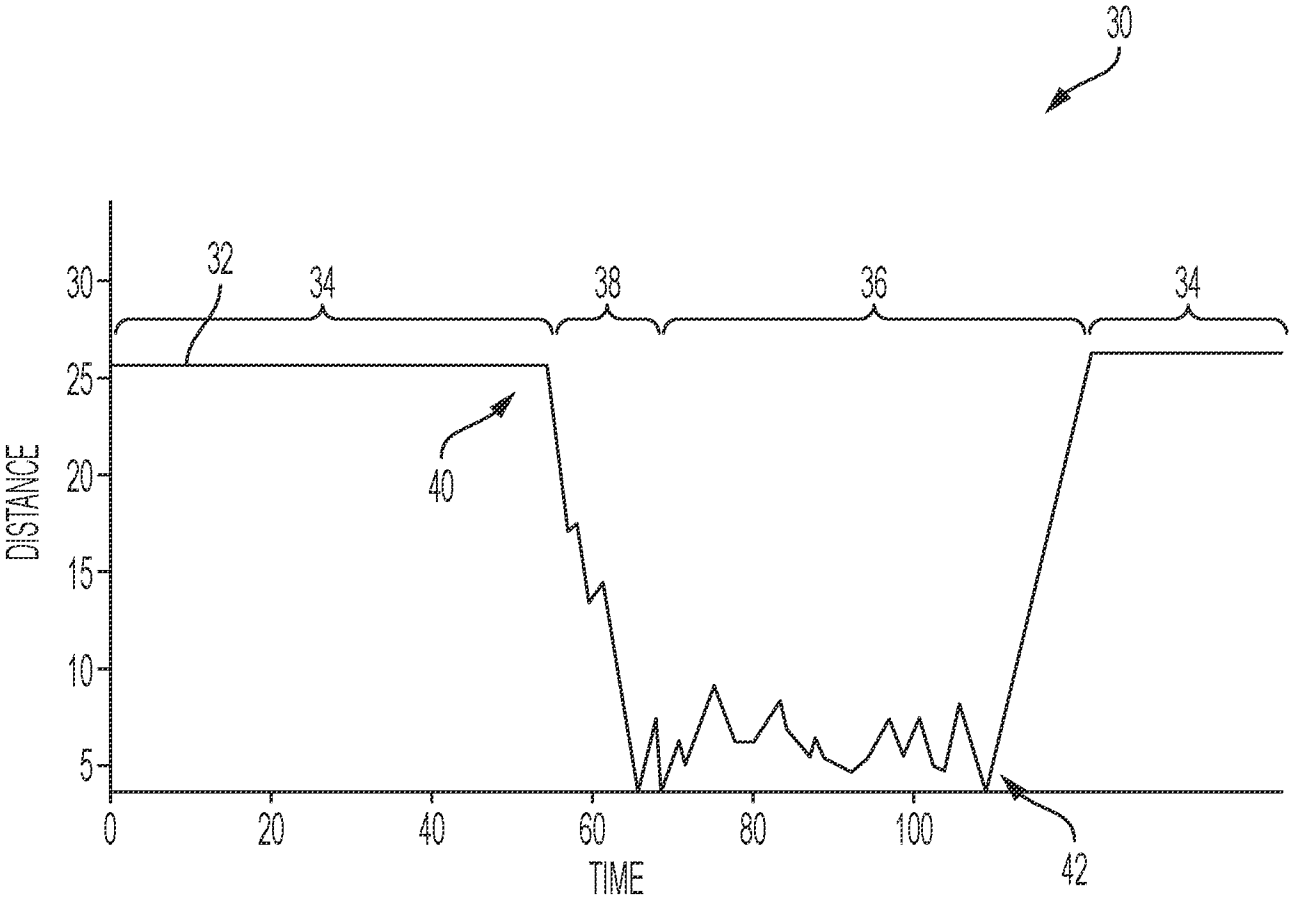
FIG. 10 is a graph illustrating an example of the sensor output data during a dispense cycle and associated with various operating conditions of the touchless beverage valve assembly.

FIG. 10 is a graph 30 that presents an example of an output signal 32 provided by the optical sensor/controller 3 to the controller 7. The output signal 32 is exemplarily an indication of measured distance (but may also be an indication of detected proximity) over time. Initially, the graph 30 presents the standby condition 34 in which the nominal distance, e.g. 26 cm is measured. At reference point 40, a user exemplarily introduces a cup below the nozzle. Initially, the signal is transitory as the user is moving the cup into position, as described in further detail below, this may be interpreted by the controller 7 as a detection condition 38, but the controller 7 may remain in this condition until the output signal 32 persists for a predetermined time (e.g. 100 ms or 200 ms or another predetermined time period) and/or the output signal 32 stabilizes, indicative of the cup resting in a position to be filled. Upon this determination, the controller 7 may operate to an active dispensing condition 36 whereby the solenoid 9 is operated to actuate the valve 10 from the closed condition into the open condition, and beverage is dispensed through the valve 10 into and through the nozzle 14 into the cup 15. As described in further detail herein, the solenoid 9 may be operated to hold the valve 10 in the open condition until either of a predetermined time has elapsed or the cup is removed from the target area, for example as provided by reference point 42. Thereafter, the controller 7 operates the solenoid 9 to actuate the valve 10 from the open condition to the closed condition and remain in a standby condition 34. Further details of the operation of the optical sensor 4 and the radar sensor 5 are included below with reference to FIGS. 3-8.

Figure 3:
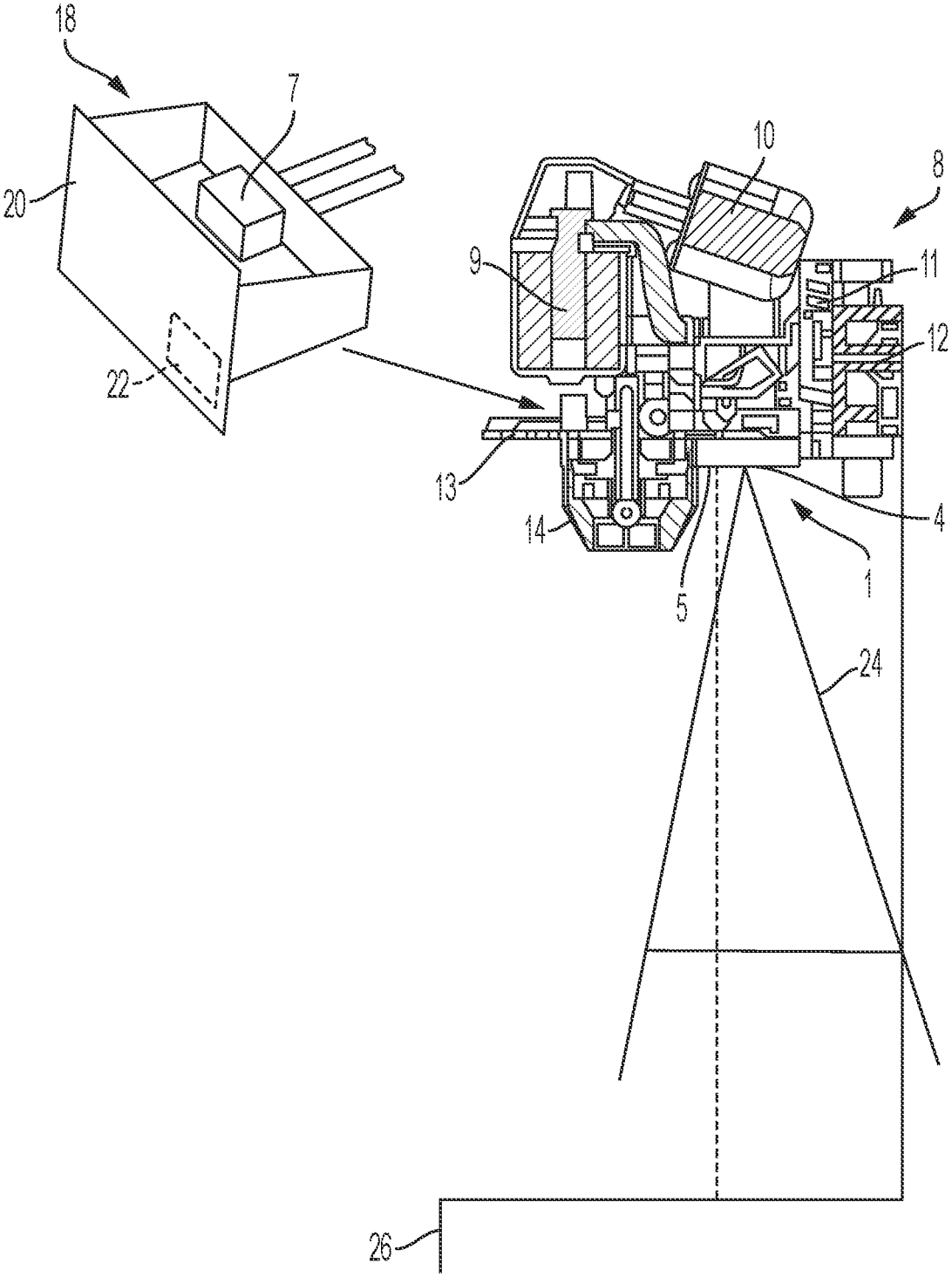
FIG. 3 is a side cross-sectional view of the touchless beverage valve assembly of during a calibration process.

Turning now to FIG. 3, a cross-sectional view of the touchless beverage valve assembly 8 during a calibration process is depicted. The feedback device 20 exemplarily includes a calibration button 22. The calibration button 22 may be a capacitive touch-sensitive button. In other examples, the calibration button 22 may be a physical button or may be another form of input sensor capable of receiving a user input to initiate the calibration process. Upon activation of the calibration button 22, the radar sensor 5 of the trigger sensor may be activated. In some implementations, a user must depress the calibration button 22 for a predetermined period of time (e.g., 5 seconds) in order to avoid initiation of the calibration process for fleeting and accidental button presses. In an exemplary implementation, the radar sensor may be a 60 GHz radar sensor 5 that can accurately measure distances from 5 mm up to 10 m, as well as detect the shape and location of objects. During the calibration process, the radar sensor may be configured to take a series of measurements of the distance between the drip tray 26 and the radar sensor 5 in order to obtain a mean distance measurement. The vertical distance difference between the position of the radar sensor 5 and the nozzle 14 may be known and used to compensate or adjust the mean distance measurement to accommodate the nozzle 14. This calibration process is described in greater detail below with reference to FIG. 7.

Figure 4:
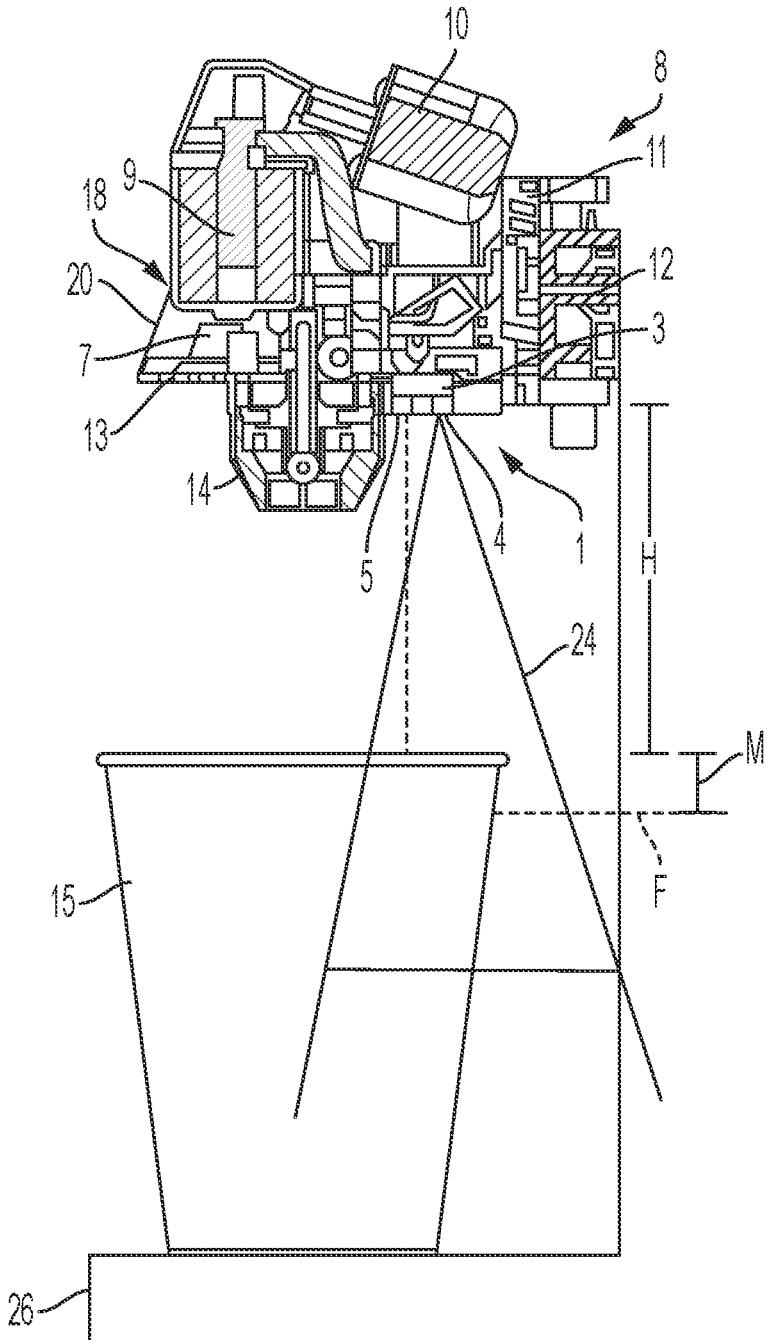
FIG. 4 is a side cross-sectional view of the touchless beverage valve assembly of FIG. 1 during a cup recognition and fill process.
Figure 5:
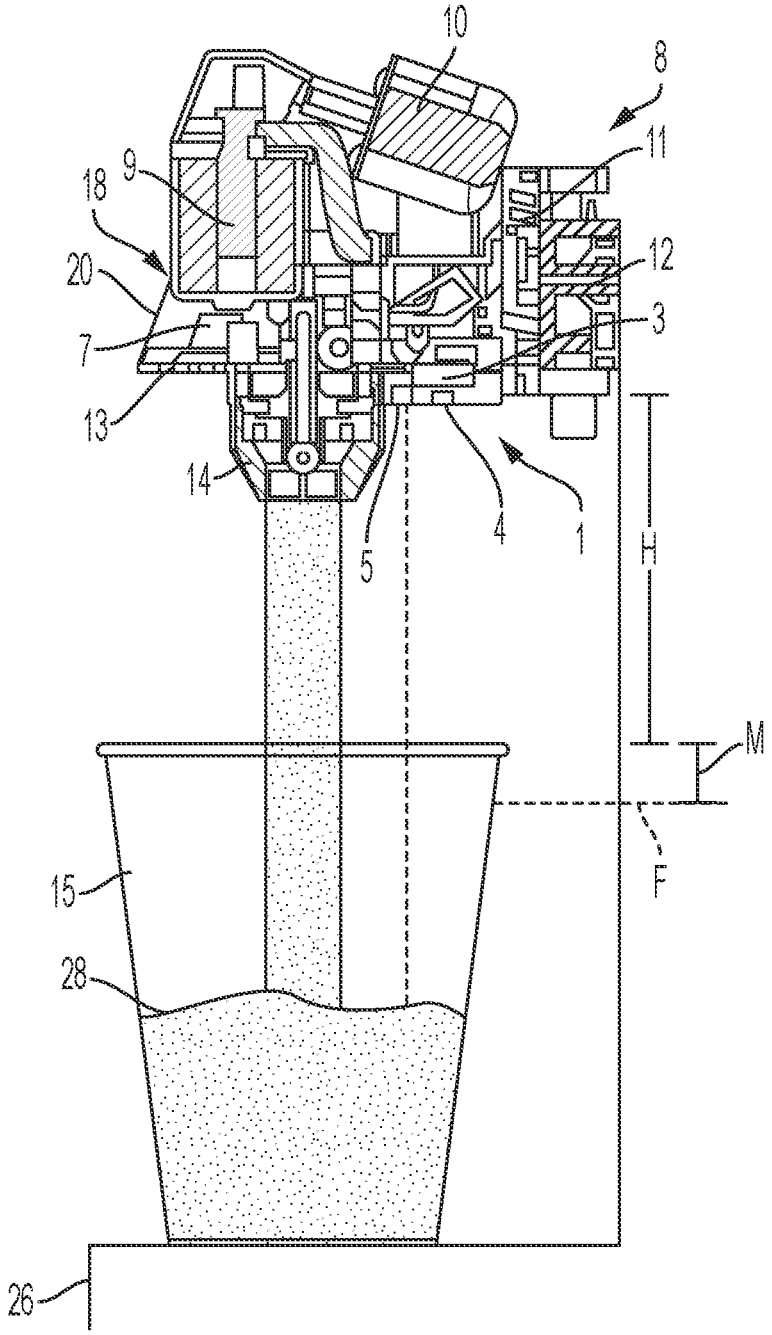
FIG. 5 is another side cross-sectional view of the touchless beverage valve assembly during a cup recognition and fill process.
Figure 6:
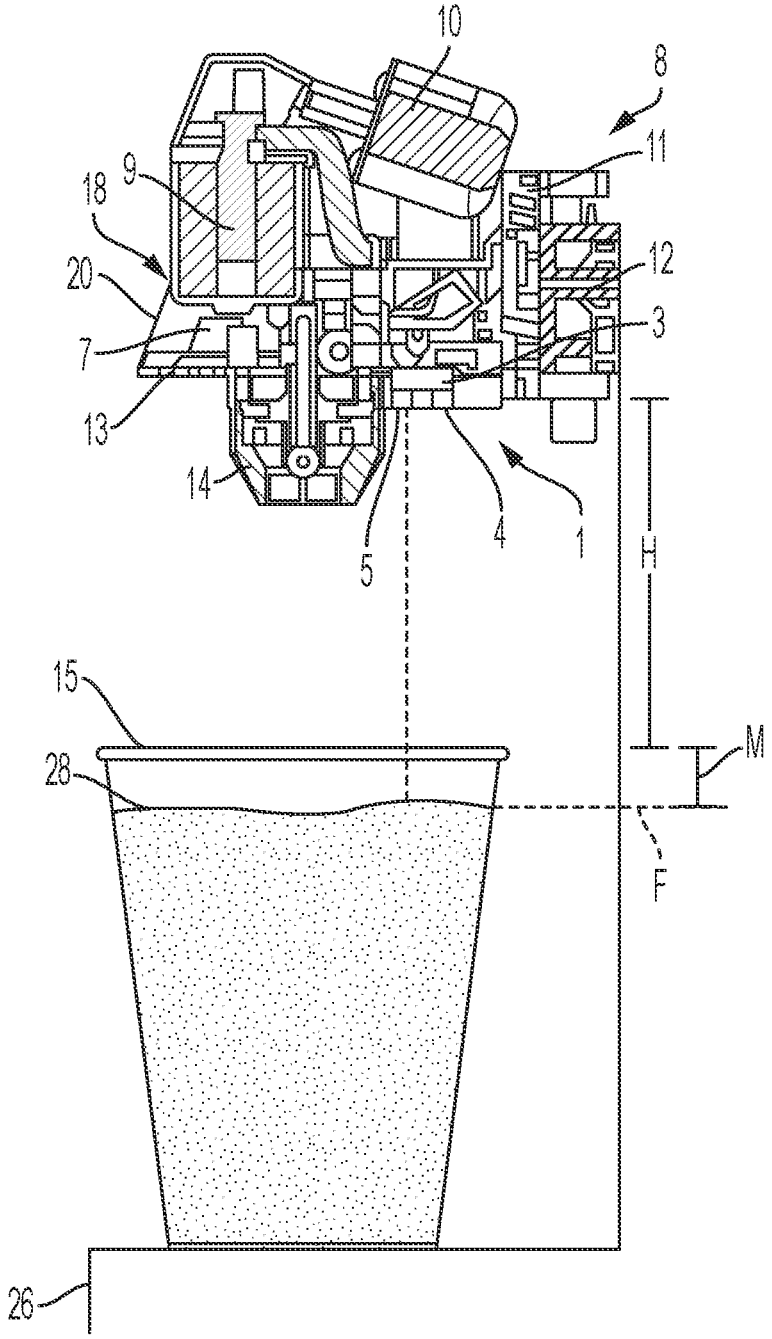
FIG. 6 is another side cross-sectional view of the touchless beverage valve assembly during a cup recognition and fill process.

Referring now to FIGS. 4-6, cross-sectional views of the touchless beverage valve assembly 8 during a cup recognition and fill process are depicted. The mean distance measurement from the radar sensor 5 to the drip tray 26 is stored in a computer readable medium accessible by the controller 7. In an example, this mean distance measurement may be a stored, fixed value, while in other examples, the mean distance measurement is calculated through the calibration process described above, and in further detail with respect to FIG. 7, or another calibration process. A user may place a cup 15 on the drip tray 26 or otherwise positioned below the nozzle 14. Advantageously, with the cup 15 supported below the nozzle 14, for example by the drip tray 26, the user is free to perform other tasks, since the touchless beverage valve assembly 8 described herein eliminates the need for the user to depress a button or lever to dispense beverage from the nozzle 14. As specifically depicted in FIG. 4, the presence of the cup 15 is detected using the infrared sensor 4 of the trigger sensor 1. The IR sensor 4 exemplarily produces a cone beam 24 of IR energization directed downwardly in the direction of the drip tray 26. IR energization reflected back from within the cone beam 24. In an example the change in an output signal from the IR sensor 4 is received and interpreted by the controller 7 to provide an indication of the presence of a cup 15 below the nozzle 14. Additional examples and description of operation of such an IR sensor 4 is provided in Applicant's co-pending U.S. patent application Ser. No. 17/313,542, which is incorporated by reference herein in its entirety. In some implementations, the fill process is only initiated once the presence of the cup 15 has been continuously detected for a predetermined period of time (e.g., 100 ms).

The IR sensor 4 may be configured to produce a signal indicative of the detection of a rear lip of the cup 15. The controller 7 is able to interpret this signal, for example as explained above, as the presence of a cup 15. Upon detection of the rear lip of the cup 15, the controller 7 determines a cup height (H) between the lip of the cup 15 and adjusted for any vertical distance between the IR sensor 4 and a lower most point of the nozzle 14. The controller 7 then calculates a target fill height by adjusting the cup height by a safety margin (M). This calculated target fill height is stored in a computer readable medium accessible by the controller 7. In various implementations, the safety margin (M) may be based on a variety of factors, including, but not limited to, the cup height, a flow speed of the nozzle, an ambient temperature, a volume of ice in the cup, and a type of beverage syrup. In still further implementations, the target fill height may be predetermined and printed on the cup 15 and/or pre-stored in the computer readable medium, to reflect the preferences and practices of particular restaurants or retail establishments. These stored predetermined safety margin and/or target fill heights by be accessible by the controller 7 for example in response to an identification of a cup size, for example by the measured cup height, or by a user or computer input indicating the cup size and beverage order to dispense. In some implementations, the safety margin may be automatically updated based on an internal model stored in a computer readable medium accessible by the controller 7. The internal model may utilize data from recent pours to determine the timing for the controller 7 to operate the solenoid 9 and stop the flow through the nozzle 14 to achieve the target fill height. The internal model may be non-linear and may associate the time of fill with the measured fill height. Non-linearity of the model may arise due to the presence of ice or foam in the cup, which may artificially increase the measured fill height above the actual beverage fill height.

As depicted in FIGS. 5 and 6, once the target fill height is determined, the controller 7 operates the solenoid 9 to cause beverage to flow through the nozzle 14. While beverage is flowing through the nozzle 14, the radar sensor 5 operates to continuously obtain a signal from which a fill height 28 of the beverage within the cup 15 is calculated. The radar sensor 5 provides this signal and/or measurement (if calculated by a sensor controller 3) to the controller 7 for processing and/or analysis. The controller 7 compares the measured fill height to the target fill height. Once the fill height 28 is equal to or exceeds the target fill height, as specifically depicted in FIG. 6, the controller 7 operates the solenoid 9 to stop the flow of beverage through the nozzle 14. It will be recognized that in examples, the added safety margin (M) may incorporate a lag time or hysteresis between the detection of the fill height 28 being equal to or exceeding the target fill height (F) and the communicative, electrical, and mechanical controls to close the valve 9 and dispense of any remaining beverage in the system after the valve 9 once the valve 9 is closed. Incorporation of these considerations results in a final fill height 28 of the beverage that is below the cup height H and suitable for delivery to the customer. Further details of the cup recognition and fill process are included below with reference to FIG. 8.

Figure 7:
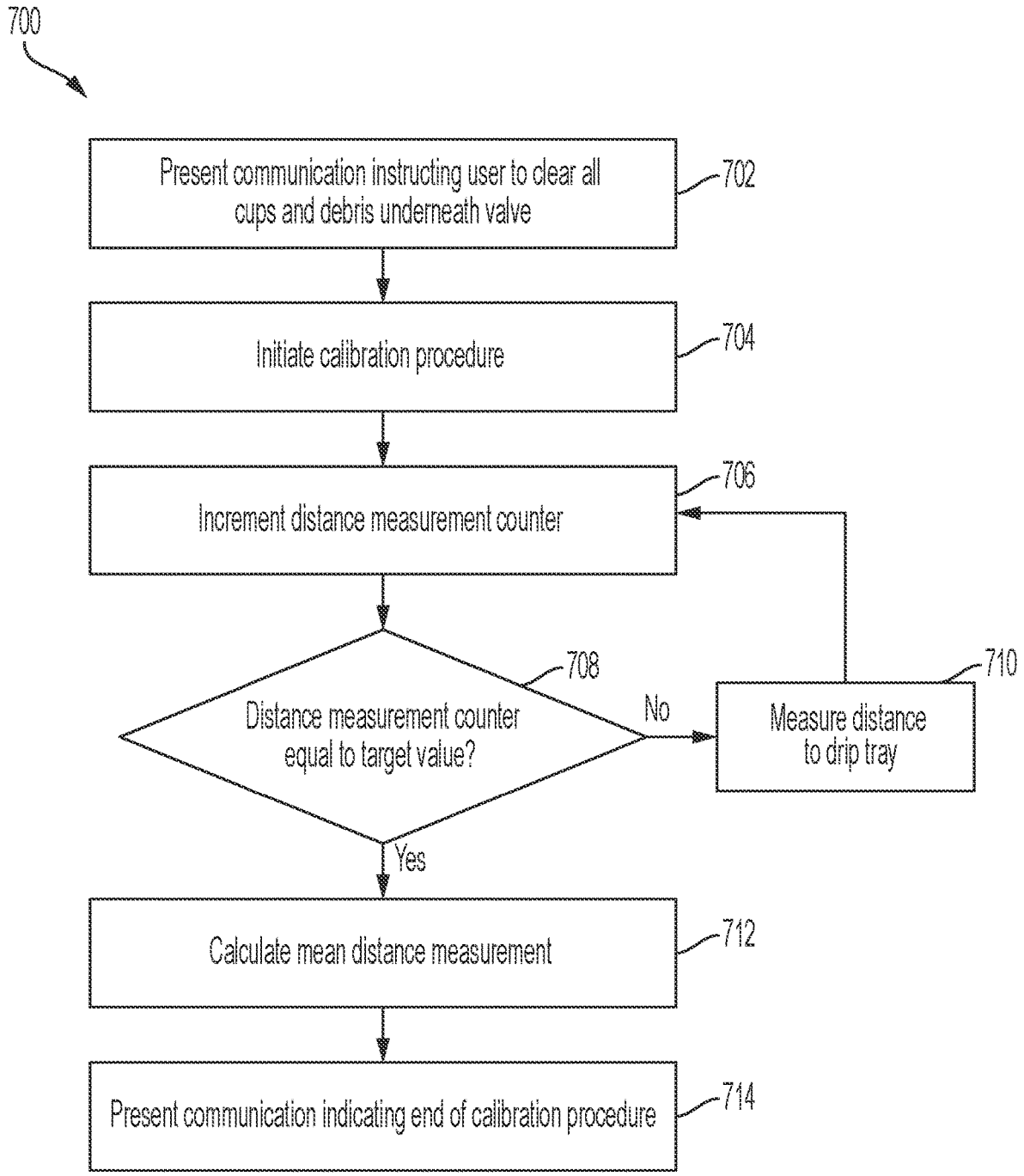
FIG. 7 is a flow chart depicting a calibration process for a touchless beverage valve assembly.

FIG. 7 is a flow chart that depicts an example of a calibration process 700 for the touchless beverage valve assembly 8 is shown. At 702, the valve assembly 8 communicates to the user to clear all cups and debris from underneath the valve. In some implementations, the signal may be visually presented as a text or graphical message to the user on feedback device 20 operable by the controller 7. In other implementations, the communication may be an audible cue or message to the user. In still further implementations, the user may be trained to clear debris from beneath the valve assembly 8 before initiating a calibration process and no signal may be provided. At 704, the controller 7 initiates the calibration procedure. In examples, the controller 7 initiates the calibration procedure in response to a user input, for example a button input as described above. In an example, the controller receives the user input, then transmits the communication at 702, followed by initiating the calibration procedure at 704. In other examples the calibration procedure may be automatically initiated as soon as power is supplied to the beverage valve assembly 8. In other words, the calibration procedure may be initiated when the ice and beverage dispenser including the beverage valve assembly 8 is plugged into an electrical outlet, after having been without power, or when the beverage valve assembly 8 is otherwise turned on.

At 706, a distance measurement counter is incremented. For example, a counter value of 0 may be incremented to 1. In various implementations, the distance measurement counter is executed as a function of the controller 7, while in other examples, the distance measurement counter may be a standalone counter circuit. The distance measurement counter thus keeps track of a number of distance measurements performed by one or more sensors of the trigger sensor 1. In an example, this may include one or both of the IR sensor 4 and radar sensor 5. The distance measurements may be utilized to calculate a mean distance measurement from the nozzle 14 to the beverage drip tray 26. The accuracy of the mean distance measurement may be proportional to the number of distance measurements performed by the calibration distance sensors. In other words, a mean distance measurement calculated from ten distance measurements may be more accurate than a mean distance measurement calculated from only three distance measurements.

At 708, controller 7 determines whether the distance measurement counter value is equal to a target value of distance measurements. The target value of distance measurements is exemplarily 10, but may be more or fewer measurements and may be a fixed value or a user-settable value. If the counter value is not equal to the target value, process 700 proceeds to 710 and at least one of the sensors of the trigger sensor, exemplarily the radar sensor 5 obtains a distance measurement to the drip tray 26. This measurement is processed by the controller 7 and stored in computer readable memory accessible thereto. After the distance to the drip tray 26 is measured, process 700 reverts to 706 and the distance measurement counter is incremented. If however, at 708, it is determined that the distance measurement counter value is equal to the target value, process 700 proceeds to 712. At 712, controller 7 calculates a mean distance measurement to the drip tray based on the distance measurements obtained by at least one of the sensors of the trigger sensor, which are exemplarily stored at a computer readable memory accessible by the controller 7. In some implementations, the mean distance measurement is obtained using a trimmed mean technique. After the mean distance measurement is calculated, the mean distance measurement is stored in a computer readable memory accessible by the controller 7.

Process 700 concludes at 714, as the valve assembly 8 presents a communication to the user indicating the completion of the calibration process. Similar to the communication at the initiation of the calibration process, the communication indicating the completion of the calibration process may be visual or audible. Examples of the calibration process 700 are thus able to be performed in a fast and automated manner. The distance between the sensors and the drip tray is a fixed distance and is not subject to variations in system operation, for example water pressure during the calibration and/or subsequent operation. Additionally, the distance measurement counter can increment through the intended number of distance measurements to produce an average distance, in a relatively rapid period of time without waiting for the time to fill a cup with beverage, or to waste the dispensed beverage after the calibration process.

Figure 8:
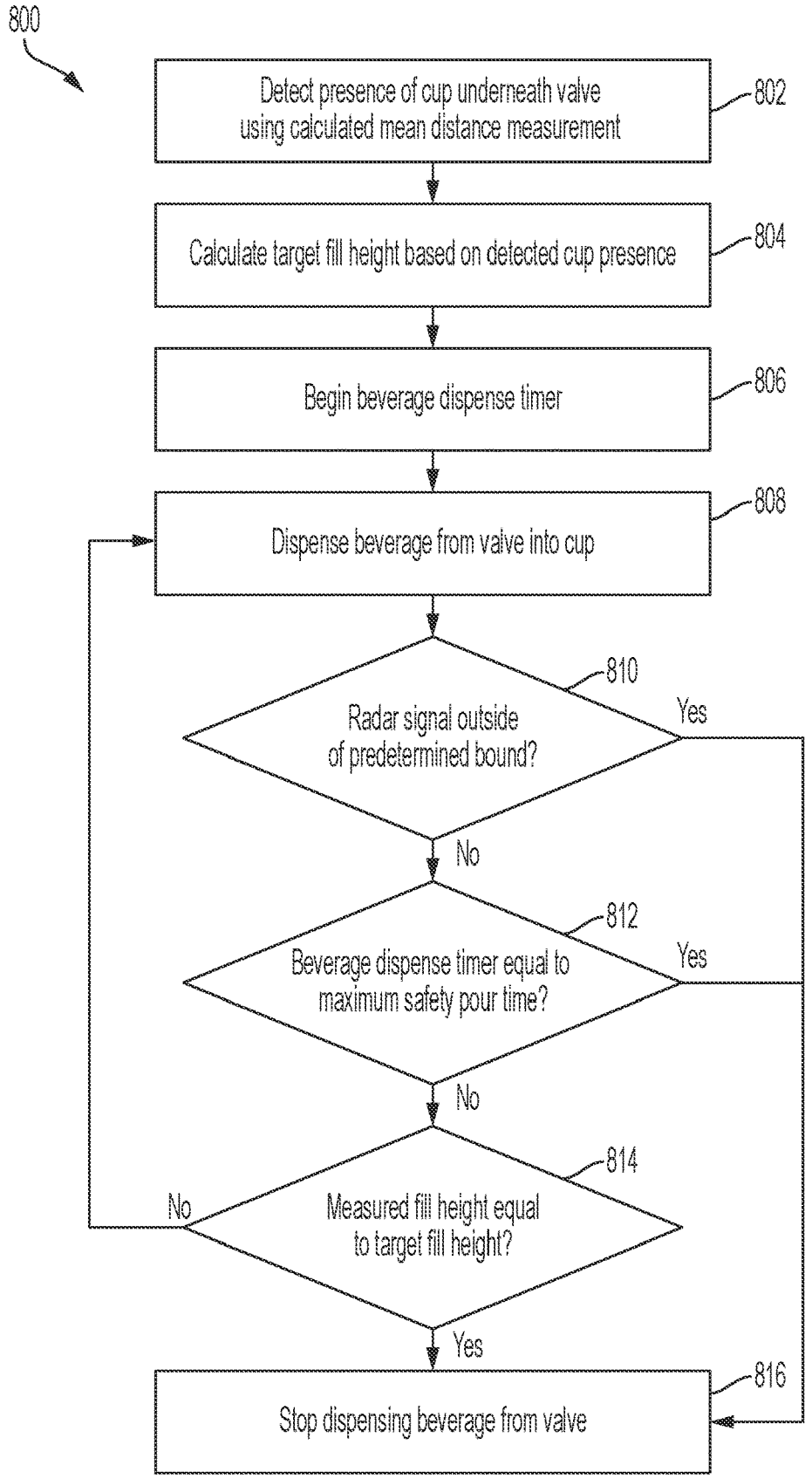
FIG. 8 is a flow chart depicting a cup recognition and fill process for a touchless beverage valve assembly.

FIG. 8 is a flow chart that depicts an example of a cup recognition and fill process 800 that may be performed by the valve assembly 8. At 802, a cup 15 is detected underneath the nozzle 14. In an exemplary implementation, the presence of the cup 15 is detected using the IR sensor 4. The presence of the cup may be determined through a measurement obtained by the IR sensor 4 that is between a predetermined distance value from the nozzle 14 and the trigger sensor 1, and the mean distance measurement to the drip tray obtained during the calibration process. The description above with respect to FIG. 10 provides further details of a processor detecting the present of a cup 15 below the nozzle 14. At 804, a cup height is determined by the controller 7 from the signals provided by the IR sensor 4 and the determined cup height is used to calculate a target fill height for the beverage. As described above, the target fill height may represent the total height (H) of the cup less a safety margin (M) that is implemented to prevent any overfill of the cup 15.

At 806, the controller 7 may initiate a beverage dispense timer and at 808, the controller 7 may operate the solenoid 9 to cause beverage to flow through the nozzle 14. Continuing with 810, the controller 7 may determine whether the cup 15 has been removed from beneath the nozzle 14, or if a user has placed a hand or other object beneath the nozzle 14. The controller 7 may determine that one of these scenarios has occurred if a signal from the radar sensor 5 indicates a fill height that is outside a predetermined bound, e.g. the cup height. As such a detection is indicative of either a removed cup or an obstruction between the nozzle and the cup, either of which presents a risk for beverage spillage, If the controller 7 identifies a fill height outside of the predetermined bound, the process 800 proceeds to 816, and the controller 7 may operates the solenoid 9 to stop dispensing beverage through the nozzle 14.

Returning 810, if the controller 7 determines radar signal has remained within the predetermined bounds of the expected fill height, process 800 proceeds to. At 812, the controller 7 compares a current value of the beverage dispense timer initiated at 806 to a maximum safety pour time. In various implementations, the maximum safety pour time may be previously stored, may be set by a user, or may be calculated by the controller based upon known dimensions of the cup, for example as determined calculation of the cup height and the target fill height, and/or a flow rate of the beverage through the nozzle 14. If the beverage dispense timer exceeds the maximum safety pour time, process 800 proceeds to 816 and the controller 7 operates the valve solenoid 9 to stop the flow of beverage through the nozzle 14.

If however, the beverage dispense timer does not exceed the maximum safety pour time, then the process 800 proceeds to 814, in which the controller 7 determines whether a beverage fill height determined by the controller 7 based upon the radar sensor signals is equal to or within a specified range of the target fill height. If the beverage fill height is not equal to the target fill height, process 800 reverts to 808. Steps 808-814 may be repeatedly performed in sequence until controller determines that the fill height measured based upon the radar sensor signals is equal to the target fill height. When the target fill height is reached, process 800 proceeds to 816, and the controller 7 operates the solenoid 9 to stop the flow of beverage through the nozzle 14.

In some implementations, the radar sensor may be configured to detect and compensate for the presence of foam in measuring the beverage fill height. In other words, an additional step between steps 814 and 816 may be performed in process 800 to determine whether foam is artificially increasing the measured beverage fill height. For example, if the controller 7 determines that the beverage fill height measured by the radar sensor exceeds an expected value due to the presence of foam, the controller 7 may operate the valve solenoid 9 to stop the flow of beverage through the nozzle 14 and permit the foam to disperse before reverting to step 808 and operating the solenoid 9 to restart the flow of beverage through the nozzle 14. In such an example, the controller 7 may access a value representative of a beverage flow rate when the solenoid 9 is open, and using such beverage flow rate calculates an expected fill height based upon the current duration of the dispense. This expected fill height may be further adjusted for any ice detected in the cup. In an example, ice may be detected in the cup and an estimation of the ice volume quantified based upon signals obtained by the radar sensor 5 prior to dispense of the beverage through the nozzle 14. Once an expected fill height is determined, the controller 7 may compare beverage fill height to the expected fill height. If the two values deviate by more than a predetermined amount, e.g. 10% although such amount may be more or less, then the controller 7 may operate the solenoid 9 to close, temporarily stopping the dispense of beverage through the nozzle 14. The controller 7 may then evaluate the signals from the radar sensor 5 to determine if the beverage fill height reaches an equilibrium. If the beverage has experienced foaming, the detected beverage fill height will reduce as the foaming settles. If an equilibrium is reached, then this may be stored as the current expected fill height, and if such equilibrium beverage fill height is below the target fill height, then the controller may operate the solenoid 9 to resume dispense of the beverage.

Figure 9:
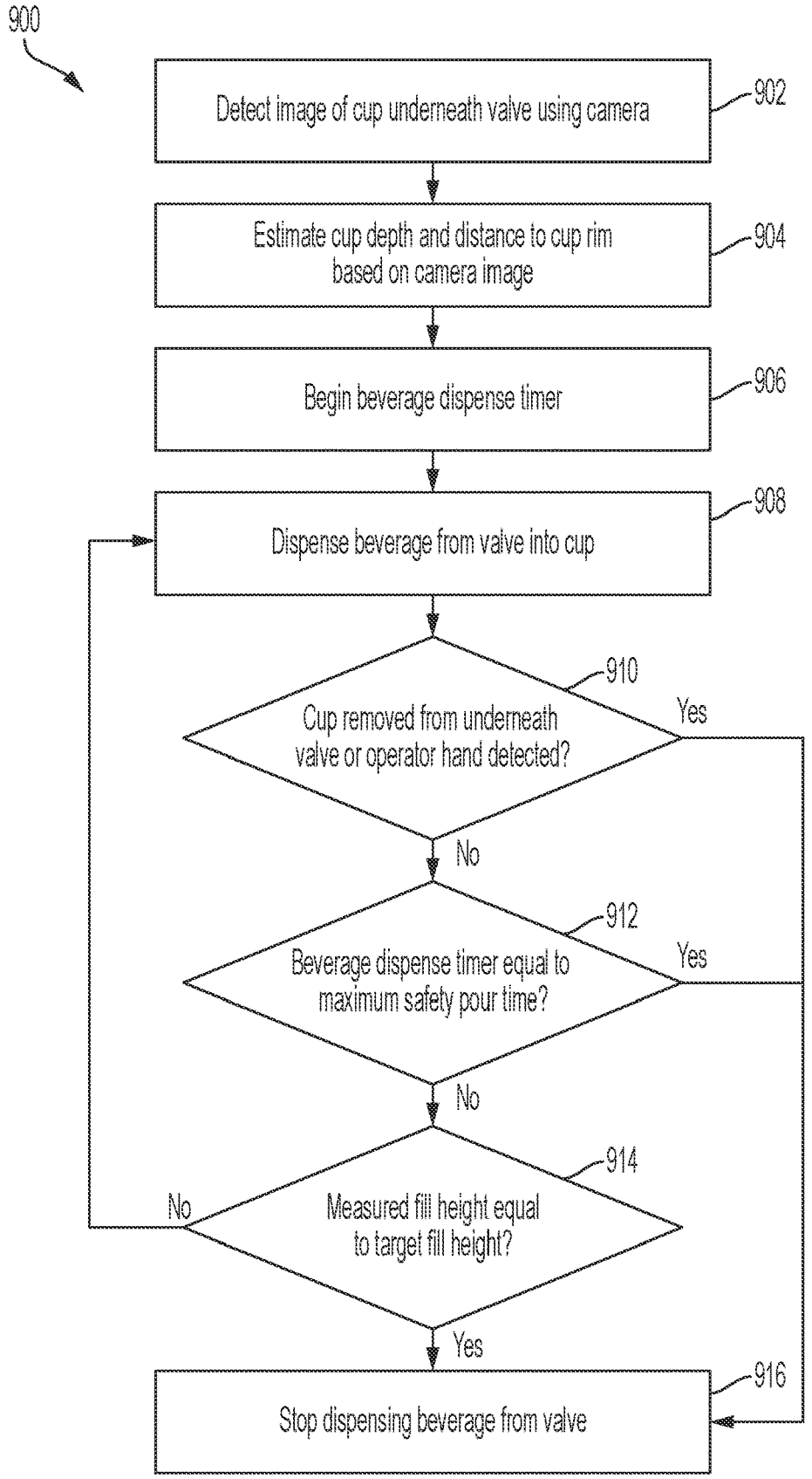
FIG. 9 is an alternate cup recognition and fill process for a touchless beverage valve assembly.

FIG. 9 is a flow chart depicting an alternative cup recognition and fill process 900. In contrast to the process 800 depicted in FIG. 8, rather than using an IR sensor to detect the presence of a cup 15, the trigger sensor 1 may include an RGB-D camera. The camera may be used at 902 to detect one or more images of the cup 15. Since an RGB-D camera is capable of obtaining both color and dense depth images, these camera images may be used to calculate a target fill height for the cup 15 based on the height and volume of the cup. Once the target fill height for the cup 15 is calculated, steps 906-916 proceed in an identical or substantially similar manner to steps 806-816 described above with reference to FIG. 8, although based upon controller analysis of the acquired camera images instead of the IR signals and the radar sensor signals.

Examples of the systems and methods as described herein present the advantages of a calibration process that is independent of the fluid inputs to the dispenser during calibration. Instead, the system is calibrated to the distance to the drip tray. Furthermore, fill detection is determined as described based upon detected heights relative to the calibrated drip tray distance. The height of the unfilled cup is detected, from which the target fill height is determined. A beverage fill height within the cup is iteratively determined and compared against the target fill height to determine when the filling operation is complete.

In some implementations, any or all of the processes above may be integrated into an existing point of sale (POS) system. For example, rather than perform the calibration process 700 described with reference to FIG. 7, the distance between the nozzle 14 and the drip tray may be stored in a memory module of the controller 7. Similarly, standard cup sizes and volumes may be stored in the memory module to eliminate the need to calculate target cup fill heights.

Citations to a number of references are made herein. The cited references are incorporated by reference herein in their entireties. If there is any inconsistency between a definition of a term in the specification as compared to a definition of the term in a cited reference, the term should be interpreted based on the definition in the specification.

In the above description, certain terms have been used for brevity, clarity, and understanding. No unnecessary limitations are to be inferred therefrom beyond the requirement of the prior art because such terms are used for descriptive purposes and are intended to be broadly construed. The different systems and method steps described herein may be used alone or in combination with other systems and methods. It is to be expected that various equivalents, alternatives, and modifications are possible within the scope of the appended claims.

The functional block diagrams, operational sequences, and flow diagrams provided in the Figures are representative of exemplary architectures, environments, and methodologies for performing novel aspects of the disclosure. While, for purposes of simplicity of explanation, the methodologies included herein may be in the form of a functional diagram, operational sequence, or flow diagram, and may be described as a series of acts, it is to be understood and appreciated that the methodologies are not limited by the order of acts, as some acts may, in accordance therewith, occur in a different order and/or concurrently with other acts from that shown and described herein. For example, those skilled in the art will understand and appreciate that a methodology can alternatively be represented as a series of interrelated states or events, such as in a state diagram. Moreover, not all acts illustrated in a methodology may be required for a novel implementation.

This written description uses examples to disclose the invention, including the best mode, and also to enable any person skilled in the art to make and use the invention. The patentable scope of the invention is defined by the claims and may include other examples that occur to those skilled in the art. Such other examples are intended to be within the scope of the claims if they have structural elements that do not differ from the literal language of the claims, or if they include equivalent structural elements with insubstantial differences from the literal languages of the claims

The invention claimed is:

1. A touchless beverage valve assembly comprising:

a nozzle;

a valve coupled upstream of the nozzle, the valve configured to control a flow of a substance through the valve to the nozzle;

a solenoid operatively connected to the valve and configured to operate the valve between an open condition and a closed condition;

an optical sensor;

a ranging sensor; and a controller configured to receive output signals from the optical sensor and the ranging sensor, to determine a cup height (H) of a cup below the nozzle based upon the output signals from the optical sensor, to calculate a target fill height based upon the cup height and a safety margin (M), and operate the solenoid to control the valve between an open condition to dispense the substance through the nozzle and a closed condition;

wherein when the valve is in the open condition, the controller is configured to determine a current fill height of beverage within the cup based upon the output signals from the ranging sensor and to calculate an expected fill height based upon at least a beverage flow rate and a dispense time, wherein the controller is configured to compare the current fill height to the target fill height and to the expected fill height, and the controller is configured to operate the solenoid to control the valve to the closed condition if the current fill height exceeds either the target fill height or the estimated fill height by a predetermined amount.

2. The touchless beverage valve assembly of claim 1, wherein the controller is configured to detect a presence of the cup below the nozzle based upon the output signals from the optical sensor.

3. The touchless beverage valve assembly of claim 1, wherein the ranging sensor is a radar sensor.

4. The touchless beverage valve assembly of claim 1, wherein when the current fill height exceeds the expected fill height by the predetermined amount, the controller is further configured to evaluate the current fill height until the current fill height reaches an equilibrium.

5. The touchless beverage valve assembly of claim 4, wherein the controller is configured, once the current fill height reaches an equilibrium, to compare the current fill height to the target fill height and if the current fill height is below the target fill height to operate the solenoid to control the valve to the open condition.

6. The touchless beverage valve assembly of claim 5, wherein the controller is configured to store the current fill height, when the current fill height reaches an equilibrium, as the expected fill height, and to continue calculating the expected fill height from the stored expected fill height.

7. The touchless beverage valve assembly of claim 1, wherein when the current fill height exceeds the estimated fill height by the predetermined amount, the controller is further configured to evaluate the current fill height until the current fill height reaches an equilibrium, the controller is configured to then compare the current fill height to the target fill height and operate the solenoid to control the valve to the open condition if the current fill height is below the target fill height.

8. The touchless beverage valve assembly of claim 1, wherein the optical sensor is an infrared (IR) sensor.

9. The touchless beverage valve assembly of claim 1, further comprising a drip tray positioned below the nozzle and configured to support a cup.

10. The touchless beverage valve assembly of claim 9, wherein the controller is configured to perform a calibration routine wherein the controller calculates an average distance measurement based upon a plurality of distance measurements using the output signals from at least the optical sensor.

11. The touchless beverage valve assembly of claim 10, wherein the controller is configured to detect a presence of a cup below the nozzle based upon the output signals from the optical sensor compared to the average distance measurement.

* * * * *